US009797191B2

(12) United States Patent
Huang

(10) Patent No.: US 9,797,191 B2
(45) Date of Patent: Oct. 24, 2017

(54) DRIVING DEVICE FOR WINDOW BLIND

(71) Applicant: TAICANG KINGFU PLASTIC MANUFACTURE CO., LTD, Jiangshu Province (CN)

(72) Inventor: Szu-Chang Huang, Fusing Township, Changhua County (TW)

(73) Assignee: TAICANG KINGFU PLASTIC MANUFACTURE CO. LTD., Taicang, Jiangshu Province (CN)

( * ) Notice: Subject to any disclaimer, the term of this patent is extended or adjusted under 35 U.S.C. 154(b) by 0 days.

(21) Appl. No.: 15/178,959

(22) Filed: Jun. 10, 2016

(65) Prior Publication Data

US 2017/0226793 A1 Aug. 10, 2017

(30) Foreign Application Priority Data

Feb. 5, 2016 (CN) ..... 2016 2 0114613 U

(51) Int. Cl.
*E06B 9/322* (2006.01)

(52) U.S. Cl.
CPC ..... *E06B 9/322* (2013.01)

(58) Field of Classification Search
CPC ..... E06B 2009/3222; E06B 9/368
USPC ..... 160/168.1 R, 168.1 V, 168.1 P, 170, 171, 160/177 R, 177 V, 173 R, 173 V
See application file for complete search history.

(56) References Cited

U.S. PATENT DOCUMENTS 4,657,060 A * 4/1987 Kaucic ..... E06B 9/361 160/168.1 V
4,834,163 A * 5/1989 Dickstein ..... E06B 9/361 160/176.1 R
4,850,416 A * 7/1989 Evers ..... E06B 9/264 160/107
5,575,323 A * 11/1996 Smuckler ..... E06B 9/361 160/177 V
5,636,677 A * 6/1997 Liu ..... E06B 9/361 160/177 R
5,957,184 A * 9/1999 Gross ..... E06B 9/322 160/177 R
6,148,893 A * 11/2000 Cadorette ..... E06B 9/32 160/176.1 P
6,332,491 B1 * 12/2001 Rossini ..... E06B 9/264 160/107
6,910,515 B2 * 6/2005 Nien ..... E06B 9/32 160/168.1 P
7,204,292 B2 * 4/2007 Nien ..... E06B 9/76 160/168.1 R (Continued)

*Primary Examiner* — Blair M Johnson
(74) *Attorney, Agent, or Firm* — Royse Law Firm, PC

(57) ABSTRACT

A driving device includes a mounting frame, a driving rod, a driving gear, a worm, primary and auxiliary input members, and a reduction gear train. The mounting frame is connected to a frame unit. The driving rod is connected to a blind unit and is rotatable about a first axis. The driving gear is connected to the driving rod. The primary input member is rotatable about a second axis. The worm is connected to the primary input member and meshes with the driving gear. The auxiliary input member is rotatable about the second axis. The reduction gear train is connected between the primary and auxiliary input members, such that rotation of the auxiliary input member drives the primary input member to rotate at a speed different from that of the auxiliary input member.

10 Claims, 6 Drawing Sheets

(56) References Cited

U.S. PATENT DOCUMENTS

| | | | | |
|---|---|---|---|---|
| 7,216,688 | B2 * | 5/2007 | Huang | E06B 9/36 160/168.1 R |
| 7,281,562 | B2 * | 10/2007 | Huang | E06B 9/322 160/168.1 P |
| 7,562,600 | B2 * | 7/2009 | Liu | F16H 1/16 160/176.1 R |
| 7,717,153 | B2 * | 5/2010 | Gramsch | E06B 9/361 160/168.1 V |
| 7,880,409 | B2 * | 2/2011 | Miller | G03B 7/26 160/168.1 P |

* cited by examiner

DRIVING DEVICE FOR WINDOW BLIND

CROSS-REFERENCE TO RELATED APPLICATION

This application claims priority of Chinese Patent Application No. 201620114613.2, filed on Feb. 5, 2016.

FIELD

The disclosure relates to a driving device, more particularly to a driving device for a window blind.

BACKGROUND

Conventional window blinds may include a frame unit, and a blind unit that is mounted to the frame unit and that is controlled by an operation cord. However, such an operation cord may cause safety concerns especially when the conventional window blinds are disposed at places where the operation cord can be reached by children.

SUMMARY

Therefore, an object of the disclosure is to provide a driving device that can alleviate may alleviate the drawback of the prior art.

According to the present disclosure, a driving device is adapted for a window blind including a frame unit and a blind unit that is mounted to the frame unit. Such a driving device may include a mounting frame, a driving rod, a driving gear, a worm, a primary input member, an auxiliary input member, and a reduction gear train.

The mounting frame is adapted to be connected fixedly to the frame unit of the window blind. The driving rod is adapted to be connected to the blind unit, is rotatably mounted to the mounting frame, and is rotatable about a first axis for operation of the blind unit. The driving gear is co-rotatably connected to the driving rod. The primary input member is rotatably mounted to the mounting frame and is rotatable about a second axis that is different from the first axis. The worm is co-rotatably connected to the primary input member and meshes with the driving gear. The auxiliary input member is rotatably mounted to the mounting frame and is rotatable about the second axis. The reduction gear train is connected between the primary input member and the auxiliary input member, such that rotation of the auxiliary input member drives the primary input member to rotate at a speed different from that of the auxiliary input member.

BRIEF DESCRIPTION OF THE DRAWINGS

Other features and advantages of the disclosure will become apparent in the following detailed description of the embodiment(s) with reference to the accompanying drawings, of which.

DETAILED DESCRIPTION

Figure 1:
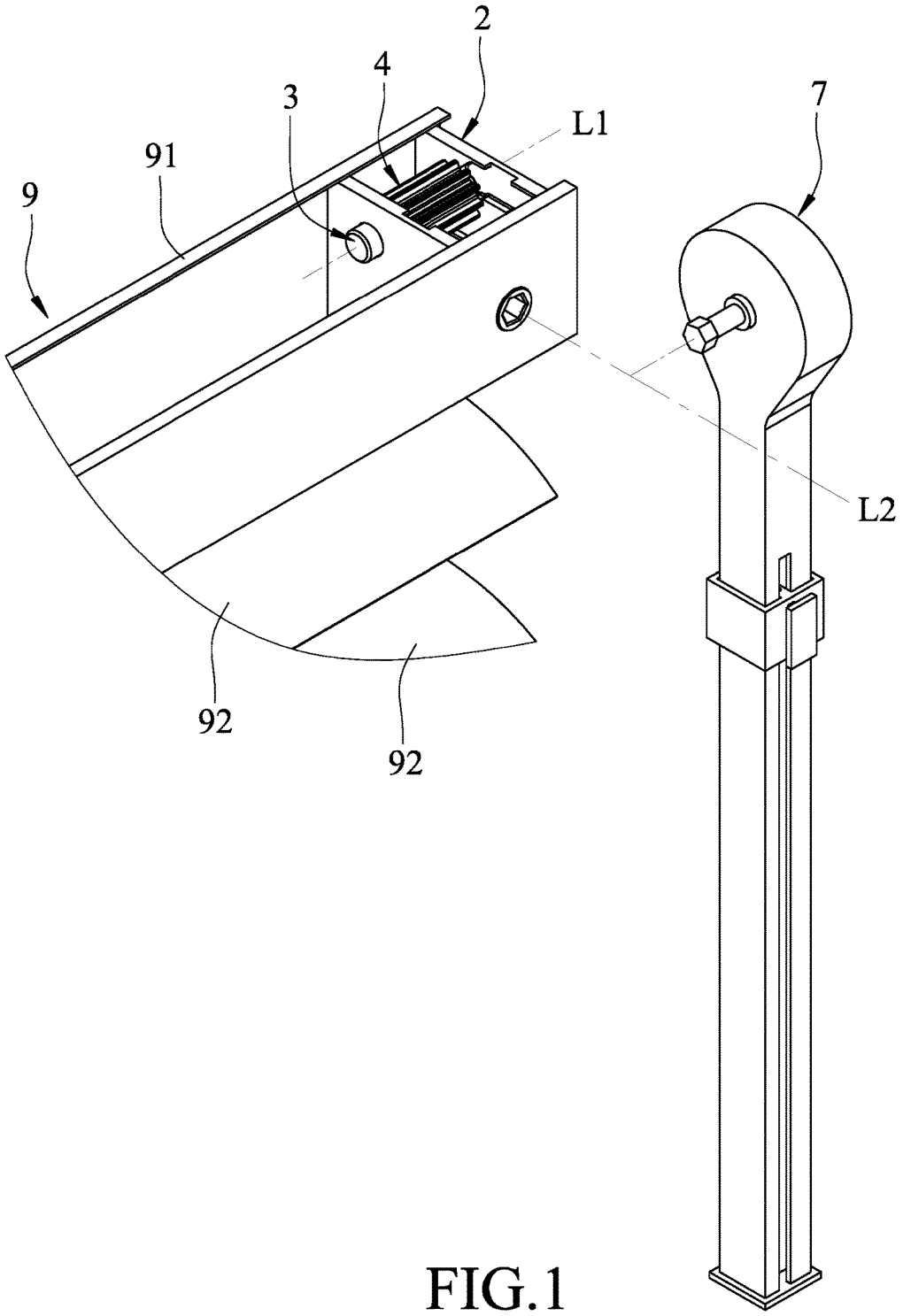
FIG. 1 is a partly exploded perspective view of an exemplary embodiment illustrating a driving device which includes a first operation pole.
Figure 2:
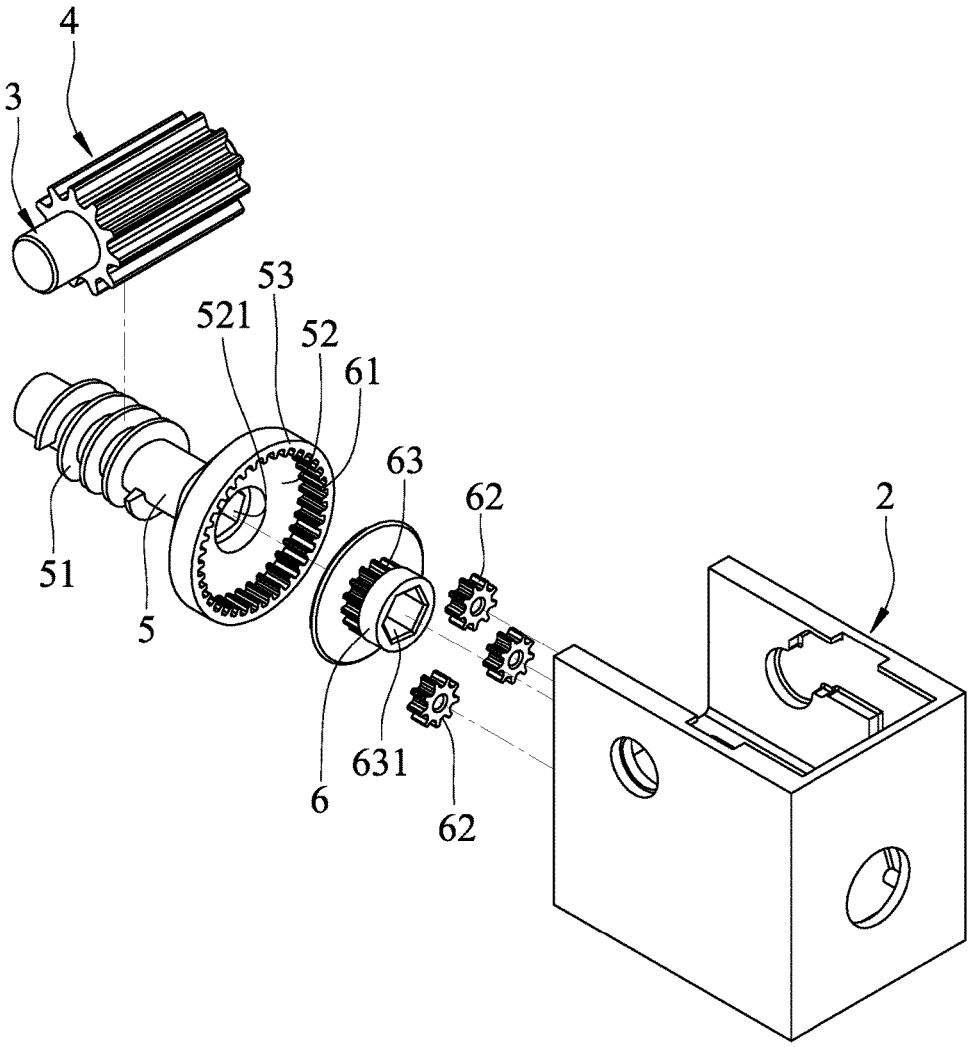
FIG. 2 is an exploded perspective view of the exemplary embodiment.
Figure 3:
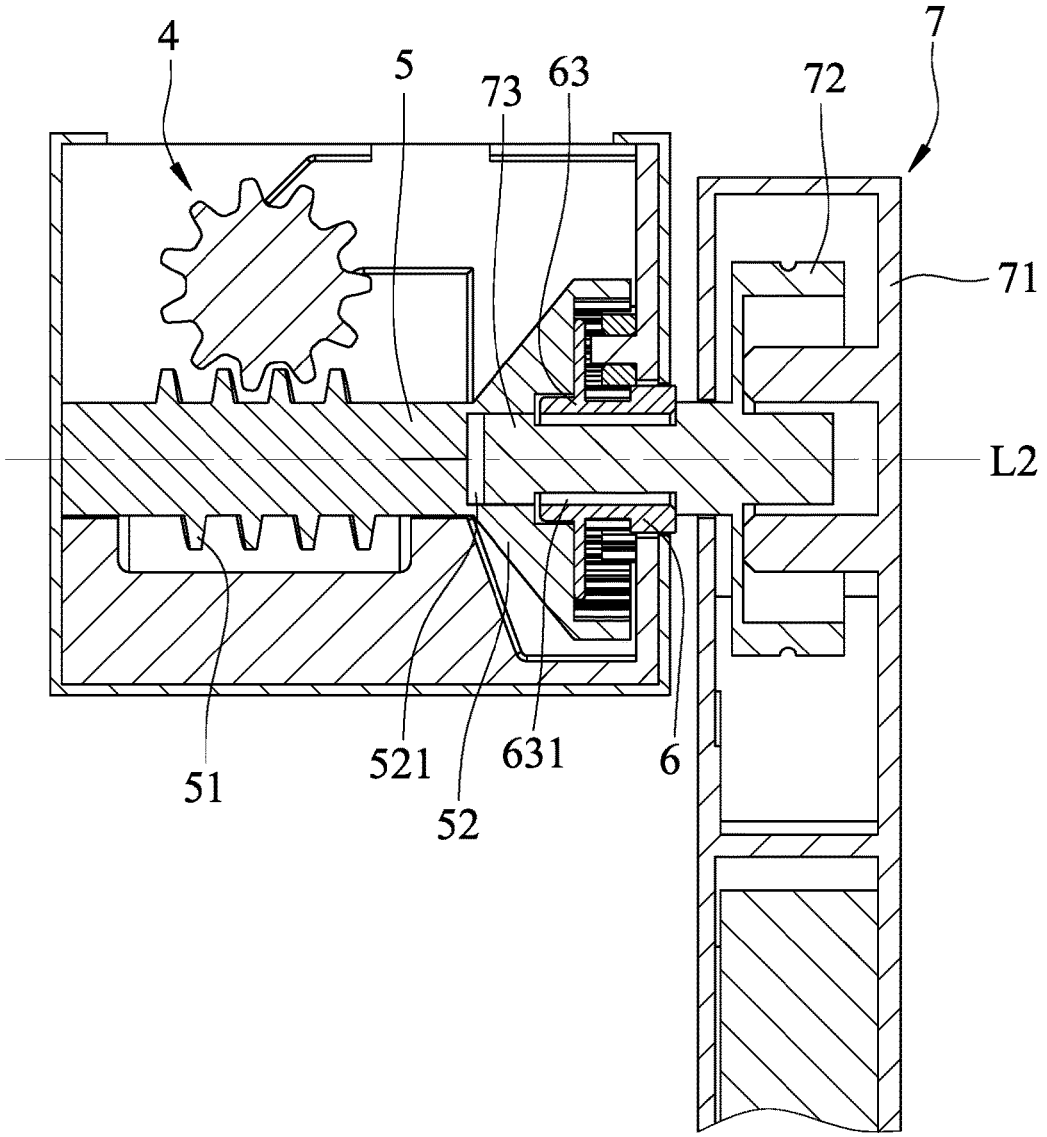
FIG. 3 is a fragmentary sectional view of the exemplary embodiment.

Referring to FIGS. 1 to 3, one exemplary embodiment of a driving device is adapted for use in a window blind 9. The window blind 9 may include a mounting unit 91, and a blind unit including a slat-driving module (not shown in the figures) mounted to the mounting unit 91, and a plurality of slat members 92 that are linked to the slat-driving module.

As illustrated in FIGS. 1 to 3, the driving device of the exemplary embodiment according to the present disclosure may include a mounting frame 2, a driving rod 3, a driving gear 4, a primary input member 5, a worm 51, an auxiliary input member 6 and a reduction gear train.

The mounting frame 2 of this embodiment is adapted to be connected fixedly to the mounting unit 91 of the window blind 9 as illustrated in FIG. 1.

The driving rod 3 is adapted to be connected to the mounting frame 2, is adapted to be linked to the slat-driving module, and is rotatable about a first axis (L1) for operation of the blind unit 92.

The driving gear 4 is co-rotatably connected to the driving rod 3. In this embodiment, the driving gear 4 and the driving rod member 3 may be integrally formed as one piece as illustrated in FIG. 2. In this embodiment, the driving gear 4 is a worm gear.

The primary input member 5 is rotatably mounted to the mounting frame 2 and is rotatable about a second axis (L2) that is different from the first axis (L1). In this embodiment, the first axis (L1) is perpendicular to the second axis (L2) as illustrated in FIG. 1. The worm 51 is co-rotatably connected to the primary input member 5 and is meshed with the driving gear 4. In this embodiment, the worm 51 is formed on the primary input member 5. In this embodiment, the primary input member 5 has a base portion 52 that is connected to and extends away from the worm 51 in the second axis (L2) and that is formed with a first axial hole 521 extending in the second axis (L2).

The auxiliary input member 6 is rotatably mounted to the mounting frame 2, and is rotatable about the second axis (L2).

The reduction gear train is connected between the primary input member 5 and the auxiliary input member 6, such that rotation of the auxiliary input member 6 drives the primary input member to rotate at a speed different from that of the auxiliary input member 6, e.g., to rotate at a speed lower than that of the auxiliary input member 6. In this embodiment, the reduction gear train includes an annular gear 61 that is co-rotatably connected to the primary input member 5, a sun gear 63 that is co-rotatably connected to the auxiliary input member 6, and at least one planet gear 62 (three planet gears are shown in the figures) that is rotatably mounted to the mounting frame 2 and that is meshed with the annular gear 61 and the sun gear 63. It may be noted that, in this embodiment, the annular gear 61 and the primary input member 5 are integrally formed as one piece and are formed on an end surface of the base portion 52 that is opposite to the worm 51 in the second axis (L2). It may also be noted that, in this embodiment, the sun gear 63 and the auxiliary input member 6 are integrally formed as one piece and are made of a metal material that is magnetically attractable. As shown in FIGS. 2 and 3, the auxiliary input member 6 is formed with a second axial hole 631 that extends along the second axis (L2) through the sun gear 63 and that is in spatial communication with the first axial hole 521.

As illustrated in FIG. 1, the driving device may further include a first operation pole 7, which includes a first shell body 71, a rotating member 72 rotatably disposed in the first shell body 71, and a first engaging portion 73 extending outwardly of the first shell body 71 and co-rotatably connected to the rotating member 72. The first engaging portion 73 of the first operation pole 7 may removably engage the first axial hole 521 such that the rotating member 72 is co-rotatably connected to the primary input member 5 for driving rotation of the primary input member 5. In this embodiment, the first engaging portion 73 and the first axial hole 521 may have complementary polygonal shapes, e.g., a hexagonal shape as illustrated in FIG. 1. In this embodiment, the first engaging portion 73 exhibits magnetic characteristics.

While using the driving device of the exemplary embodiment, the first engaging portion 73 of the first operation pole 7 may be first inserted through the second axial hole 631, then through the first axial hole 521 to engage the first axial hole 521, followed by rotating the rotating member 72, for example, by manual power through a cord (not shown in the figures) received in the first shell body 71, so as to drive rotation of the primary input member 5 via the engagement between the first engaging portion 73 and the first axial hole 521. The rotation of the primary input member 5 drives the driving gear 4 to rotate by way of the worm 51 so as to drive the driving rod 3 to rotate in the first axis (L1). Since the driving rod 3 is connected to the slat-driving module of the blind unit 92, the rotation of the driving rod 3 may then drive movement of the slat members 92, e.g., raising/lowering of the slat members 92, through the slat-driving module. It is worth noting that, since the first engaging portion 73 of this embodiment exhibits magnetic characteristics, the sun gear 63 and the auxiliary input member 6 may attract the first engaging portion 73 of the first operation pole 7 when the first engaging portion 73 is inserted into the first axial hole 521 so as to further enhance the engagement between the primary input member 5 and the first engaging portion 73 of the first operation pole 7.

Figure 4:
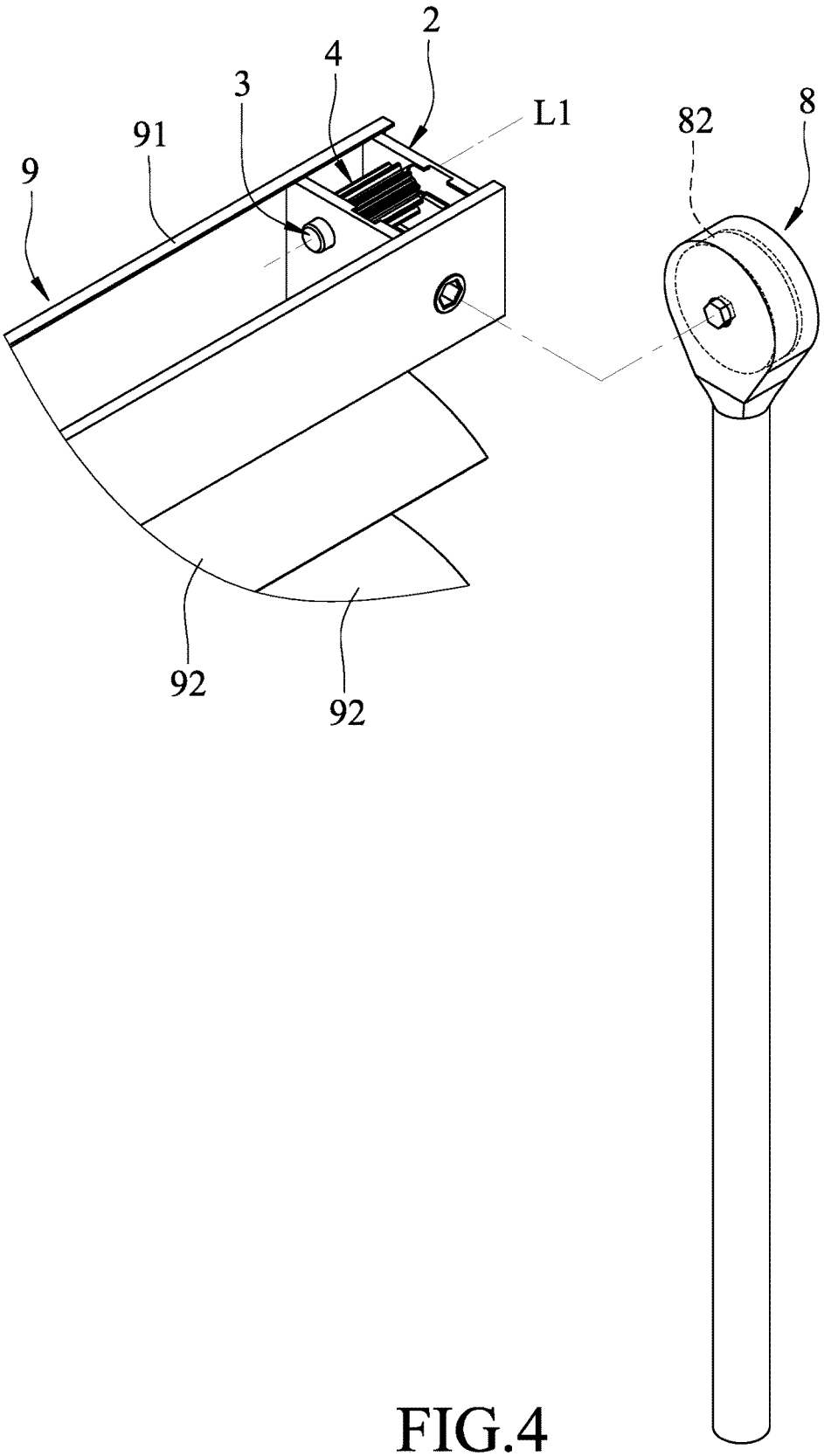
FIG. 4 is a partly exploded perspective view illustrating the exemplary embodiment of the driving device which includes a second operation pole.
Figure 5:
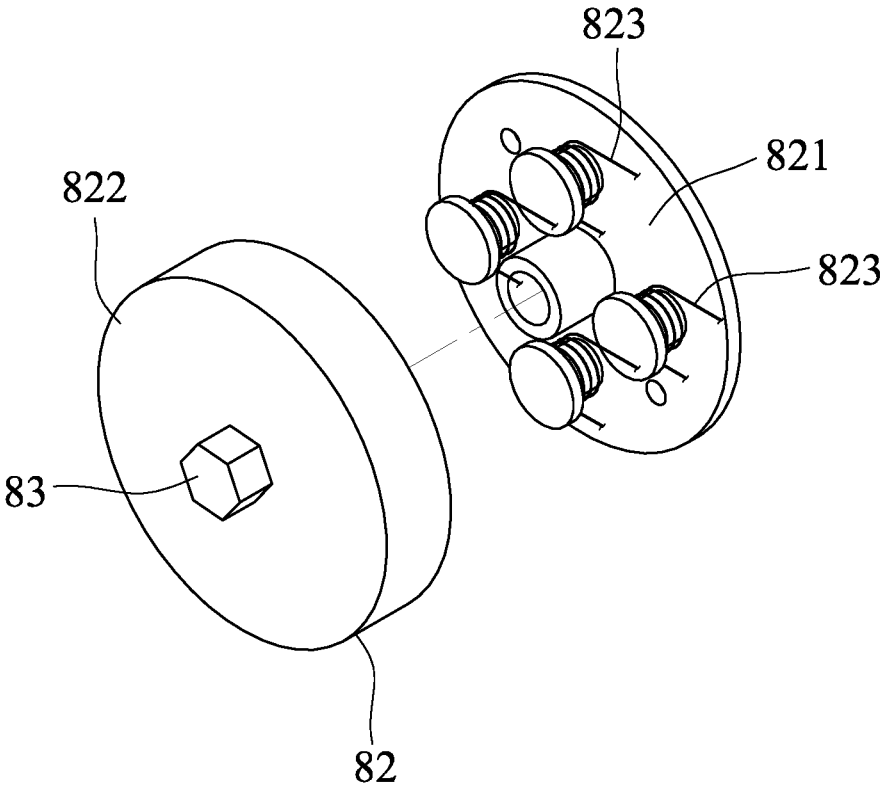
FIG. 5 is a partly exploded perspective view of the exemplary embodiment, illustrating an electromagnetic rotating member of the second operation pole.
Figure 6:
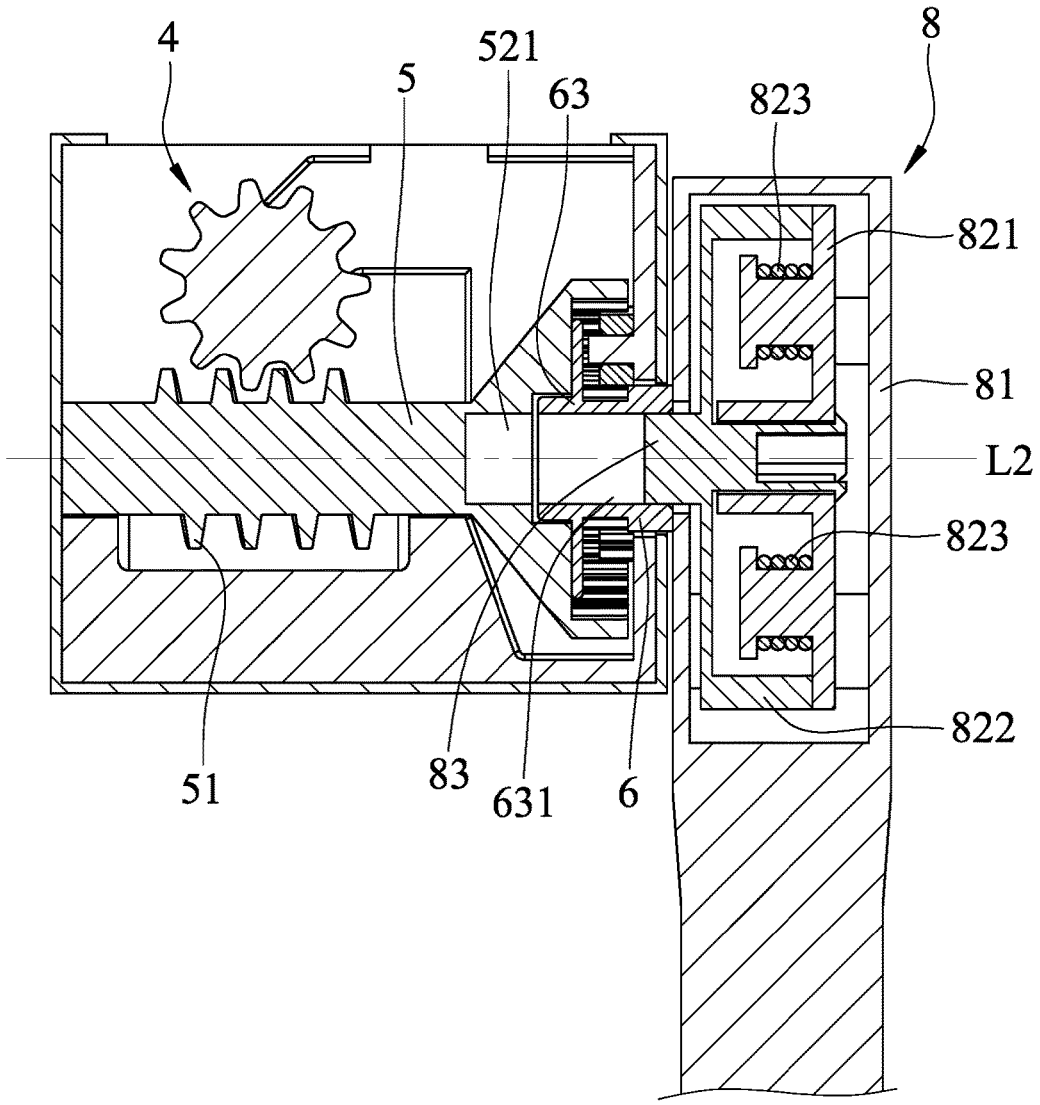
FIG. 6 is a sectional view of the exemplary embodiment.

Alternatively, referring to FIG. 4, the driving device may include a second operation pole 8 instead of the first operation pole 7. As illustrated in FIGS. 4 to 6, the second operation pole 8 may include a second shell body 81, an electromagnetic driving unit 82 disposed in the second shell body 81 and having an output element that is rotatable relative to the second shell body 81, and a second engaging portion 83 extending outwardly of the second shell body 81 and co-rotatably connected to the output element. The second engaging portion 83 may removably engage the second axial hole 631 of the auxiliary input member 6, such that the output element is co-rotatably connected to the auxiliary input member 6 for driving rotation of the auxiliary input member 6. The second engaging portion 83 and the second axial hole may have complementary polygonal shapes, e.g., the hexagonal shape as illustrated in FIG. 4. In this embodiment, the electromagnetic driving unit 82 may have a stator part 821 that is mounted to the second shell body 81 and that is able to be energized to generate a magnetic force, and a rotor part 822 that is configured to rotate relative to the stator part 821 by the magnetic force and that serves as the output element of the electromagnetic driving unit 82. As shown in FIG. 5, the stator part 821 may include a plurality of electromagnetic coils 823 configured to be energized for generating the magnetic force. When in use, the second engaging portion 83 of the second operation pole 8 may be first inserted into and engage the second axial hole 631 of the auxiliary input member 6, followed by rotating the rotor part 822 via the stator part 821, so as to drive rotation of the auxiliary input member 6. The primary input member 5 is then driven by the rotation of the auxiliary input member 6 via the reduction gear train, i.e., the sun gear 63, the planet gears 62 and the annular gear 61, to rotate in the second axis (L2), so as to drive the rotation of the driving rod 3 through the worm 51 and the driving pear 4. Since the rotation of the rotor part 822 is driven by the magnetic force generated from the electromagnetic coils 823 in the stator part 821 and may have a relatively high rotating speed, by utilizing the reduction gear chain, the rotation speed of the primary input member 5 can be adjusted to be lower than or different from that of the auxiliary input member 6. In other worlds, the driving device of the present disclosure allows for two different power inputs, i.e., one directly through rotation of the primary input member 5 by the first operation pole 7, and the other one through rotation of the auxiliary input member 6 by the second operation pole 8 with a different rotating speed it is worth rioting that, the second engaging portion 83 may exhibit magnetic characteristics, so that the auxiliary input member 6 and the sun gear 63 may attract the second engaging portion 83 of the second operation pole 8 when the second engaging portion 83 is inserted into the second axial hole 631 so as to further enhance the engagement between the auxiliary input member 6 and the second engaging portion 83 of the second operation pole 8.

In summary, by utilizing the primary input member 5, the reduction gear train, and the auxiliary input member 6, the driving device of the present disclosure is able to drive operation of the blind unit either directly through the rotation of the primary input member 5 using the first operation pole 7, or through the rotation of the auxiliary input member 6 using the second operation pole 8 via the reduction gear chain and the primary input member 5, where the rotation speed of the auxiliary input member 6 is different from, that of the primary input member 5. In addition, an operation cord is not required in the configuration of the driving device, so that the driving device of the present disclosure can alleviate the aforesaid drawback of the prior art.

In the description above, for the purposes of explanation, numerous specific details have been set forth in order to provide a thorough understanding of the embodiment(s). It will be apparent, however, to one skilled in the art, that one or more other embodiments may be practiced without some of these specific details. It should 1 so be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects.

While the disclosure has been described in connection with what is (are) considered the exemplary embodiment(s) it is understood that this disclosure is not limited to the disclosed embodiment(s) but is intended to cover various arrangements included within the spirit and scope of the broadest interpretation so as to encompass all such modifications and equivalent arrangements.

What is claimed is:

1. A driving device adapted for a window blind, the window blind including a frame unit, and a blind unit that is mounted to the frame unit, said driving device comprising:

a mounting frame adapted to be connected fixedly to the frame unit of the window blind;

a driving rod adapted to be connected to the blind unit, being rotatably mounted to said mounting frame, and being rotatable about a first axis for operation of the blind unit;

a driving gear co-rotatably connected to said driving rod;

a primary input member rotatably mounted to said mounting frame, and being rotatable about a second axis that is different from the first axis;

a worm co-rotatably connected to said primary input member, and meshing with said driving gear;

an auxiliary input member rotatably mounted to said mounting frame, and being rotatable about the second axis; and a reduction gear train connected between said primary input member and said auxiliary input member, such that rotation of said auxiliary input member drives said primary input member to rotate at a speed different than that of said auxiliary input member;

wherein said primary input member is formed with a first axial hole that extends along the second axis, said driving device further comprising a first operation pole including a first shell body, a rotating member that is rotatably disposed in said first shell body, and a first engaging portion that extends outwardly of said first shell body and that is co-rotatably connected to said rotating member, said first engaging portion removably engaging said first axial hole such that said rotating member is co-rotatably connected to said primary input member for driving rotation of said primary input member.

2. The driving device according to claim 1, wherein said reduction gear train includes an annular gear that is co-rotatably connected to said primary input member, a sun gear that is co-rotatably connected to said auxiliary input member, and at least one planet gear that is rotatably mounted to said mounting frame, and that meshes with said annular gear and said sun gear.

3. The driving device according to claim 1, wherein said first engaging portion and said first axial hole have complementary polygonal shapes.

4. The driving device according to claim 1, wherein said first engaging portion exhibits magnetic characteristics.

5. A driving device adapted for a window blind, the window blind including a frame unit, and a blind unit that is mounted to the frame unit, said driving device comprising:

a mounting frame adapted to be connected fixedly to the frame unit of the window blind;

a driving rod adapted to be connected to the blind unit, being rotatably mounted to said mounting frame, and being rotatable about a first axis for operation of the blind unit;

a driving gear co-rotatably connected to said driving rod;

a primary input member rotatably mounted to said mounting frame, and being rotatable about a second axis that is different from the first axis;

a worm co-rotatably connected to said primary input member, and meshing with said driving gear;

an auxiliary input member rotatably mounted to said mounting frame, and being rotatable about the second axis; and a reduction gear train connected between said primary input member and said auxiliary input member, such that rotation of said auxiliary input member drives said primary input member to rotate at a speed different than that of said auxiliary input member;

wherein said auxiliary input member is formed with a second axial hole that extends along the second axis, said driving device further comprising a second operation pole including:

a second shell body;

an electromagnetic driving unit disposed in said second shell body; and having an output element that is rotatable relative to said second shell body; and a second engaging portion extending outwardly of said second shell body and co-rotatably connected to said output element, said second engaging portion removably engaging said second axial hole such that said output element is co-rotatably connected to said auxiliary input member for driving rotation of said auxiliary input member.

6. The driving device according to claim 5, wherein said electromagnetic driving unit has a stator part that is mounted to said second shell body and that is able to be energized to generate a magnetic force, and a rotor part that is configured to rotate relative to said stator part by the magnetic force, and that serves as said output element of said electromagnetic driving unit.

7. The driving device according to claim 6, wherein said stator part has a plurality of electromagnetic coils.

8. The driving device according to claim 5, wherein said second engaging portion and said second axial hole have complementary polygonal shapes.

9. The driving device according to claim 5, wherein said second engaging portion exhibits magnetic characteristics.

10. The driving device according to claim 5, wherein said reduction gear train includes an annular gear that is co-rotatably connected to said primary input member, a sun gear that is co-rotatably connected to said auxiliary input member, and at least one planet gear that is rotatably mounted to said mounting frame, and that meshes with said annular gear and said sun gear.

* * * * *